US009511299B1

(12) United States Patent
Lai et al.

(10) Patent No.: US 9,511,299 B1
(45) Date of Patent: Dec. 6, 2016

(54) ROTARY DYNAMIC SIMULATION DEVICE AND AUDIOVISUAL APPARATUS USING THE SAME

(71) Applicant: Brogent Technologies Inc., Kaohsiung (TW)

(72) Inventors: Deng-Horng Lai, Kaohsiung (TW); Ke-Cheng Chien, Kaohsiung (TW); Cheng-Lin Huang, Kaosiung (TW)

(73) Assignee: BROGENT TECHNOLOGIES INC., Kaohsiung (TW)

( * ) Notice: Subject to any disclaimer, the term of this patent is extended or adjusted under 35 U.S.C. 154(b) by 0 days.

(21) Appl. No.: 15/058,831

(22) Filed: Mar. 2, 2016

(51) Int. Cl.
*A63G 31/16* (2006.01)
*A63G 31/02* (2006.01)
*A63G 31/00* (2006.01)

(52) U.S. Cl.
CPC ..... *A63G 31/02* (2013.01); *A63G 31/16* (2013.01)

(58) Field of Classification Search
CPC ..... A63G 7/00; A63G 31/00; A63G 31/02; A63G 31/16; G09B 9/00; G09B 9/04; G09B 9/05; G09B 9/08; G09B 9/12; A63B 21/225; A63B 24/0087; A63B 69/0093
USPC ..... 472/59–61, 130, 136; 434/29, 55
See application file for complete search history.

(56) References Cited

U.S. PATENT DOCUMENTS 3,469,837 A 9/1969 Heilig
5,009,412 A * 4/1991 Roodenburg ..... A63G 31/00 472/136
5,192,247 A 3/1993 Barr et al.
5,791,903 A * 8/1998 Feuer ..... G09B 9/14 434/30
8,721,464 B2 * 5/2014 Ou Yang ..... A63G 31/16 434/55
2005/0014567 A1 * 1/2005 Li ..... A63G 31/16 472/60
2010/0184524 A1 * 7/2010 Lai ..... A63G 31/02 472/137
2012/0258810 A1 10/2012 Lai et al.
2015/0030999 A1 1/2015 Lee et al.
2015/0157951 A1 6/2015 Lee et al.

FOREIGN PATENT DOCUMENTS

WO 2012144690 A1 10/2012

OTHER PUBLICATIONS

European Search Report Dated Sep. 15, 2016 of the Corresponding European Patent Application No. 16158058.4.

* cited by examiner

*Primary Examiner* — Kien Nguyen
(74) *Attorney, Agent, or Firm* — Chun-Ming Shih; HDLS IPR Services

(57) ABSTRACT

In a rotary dynamic simulation device and an audiovisual apparatus using the same, the rotary dynamic simulation device includes a fixed table (1), a motion mechanism (4), a carrying seat (3), and a rotation mechanism (4). The motion mechanism (2) having multiple degrees of freedom is disposed between the fixed table (1) and the carrying seat (3). The rotation mechanism (4) is disposed on the rack (5) to drive the fixed table (1) to rotate, so that the carrying seat (3) is rotatable between an entering position and a watch position of the rack (5).

11 Claims, 7 Drawing Sheets

ROTARY DYNAMIC SIMULATION DEVICE AND AUDIOVISUAL APPARATUS USING THE SAME

TECHNICAL FIELD

The present invention relates to an amusement facility and, in particular, to a rotary dynamic simulation device having six degrees of freedom and an audiovisual apparatus using the same wherein a Stewart platform is used.

BACKGROUND

A Stewart platform is a type of parallel platform that has six linear actuators, six universal joints above, six universal joints below, a movable platform, and a base. By the six length-adjustable linear actuators, the universal joints are maneuvered to arrange the upper movable platform in different positions and angles, so as to meet requirements in work.

In a traditional amusement facility using the Stewart platform, a gondola for seating a viewer is suspended at a certain height to provide an exciting and realistic experience for viewers. However, considering convenience and safety in seating the viewers, the gondola must be placed on the ground or the like. Therefore, the overall structure absolutely takes up quite some space to shift the cabin seat horizontally to a position to suspend it. As a result, a large amusement facility having the Stewart platform for multiple persons inevitably takes up more floor and space.

Accordingly, the inventor made various studies to improve the above-mentioned problems, on the basis of which the present invention is accomplished.

SUMMARY

It is an object of the present invention to provide a rotary dynamic simulation device and an audiovisual apparatus, wherein by rotation, it saves more floor and space. Accordingly, the present invention provides a rotary dynamic simulation device, disposed on a rack, the rack having a first position and a second position opposite to the first position. The rotary dynamic simulation device comprises a fixed table, a motion mechanism, a carrying seat, and a rotation mechanism. An arm is vertically disposed on the fixed table. The motion mechanism has multiple degrees of freedom and includes a fixed plate, a movable plate, and a plurality of telescopic rods connected between the fixed plate and the movable plate. The fixed plate is fixed on the arm. The carrying seat includes a carrying space, and the movable plate is fixed to any position at a back side of the carrying space. The rotation mechanism is disposed on the rack and drives the fixed table to rotate to thereby rotate the carrying seat from the first position to the second position. The rotary dynamic simulation device is constituted as above.

Accordingly, the present invention provides an audiovisual apparatus having the rotary dynamic simulation device, comprising a rack and a screen. At least one rotary dynamic simulation device mentioned above is disposed on the rack. The rack includes a said first position and a said second position opposite to the said first position corresponding to each of the rotary dynamic simulation devices. The screen is disposed corresponding to each second position. The audiovisual apparatus having the rotary dynamic simulation device is constituted as above.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
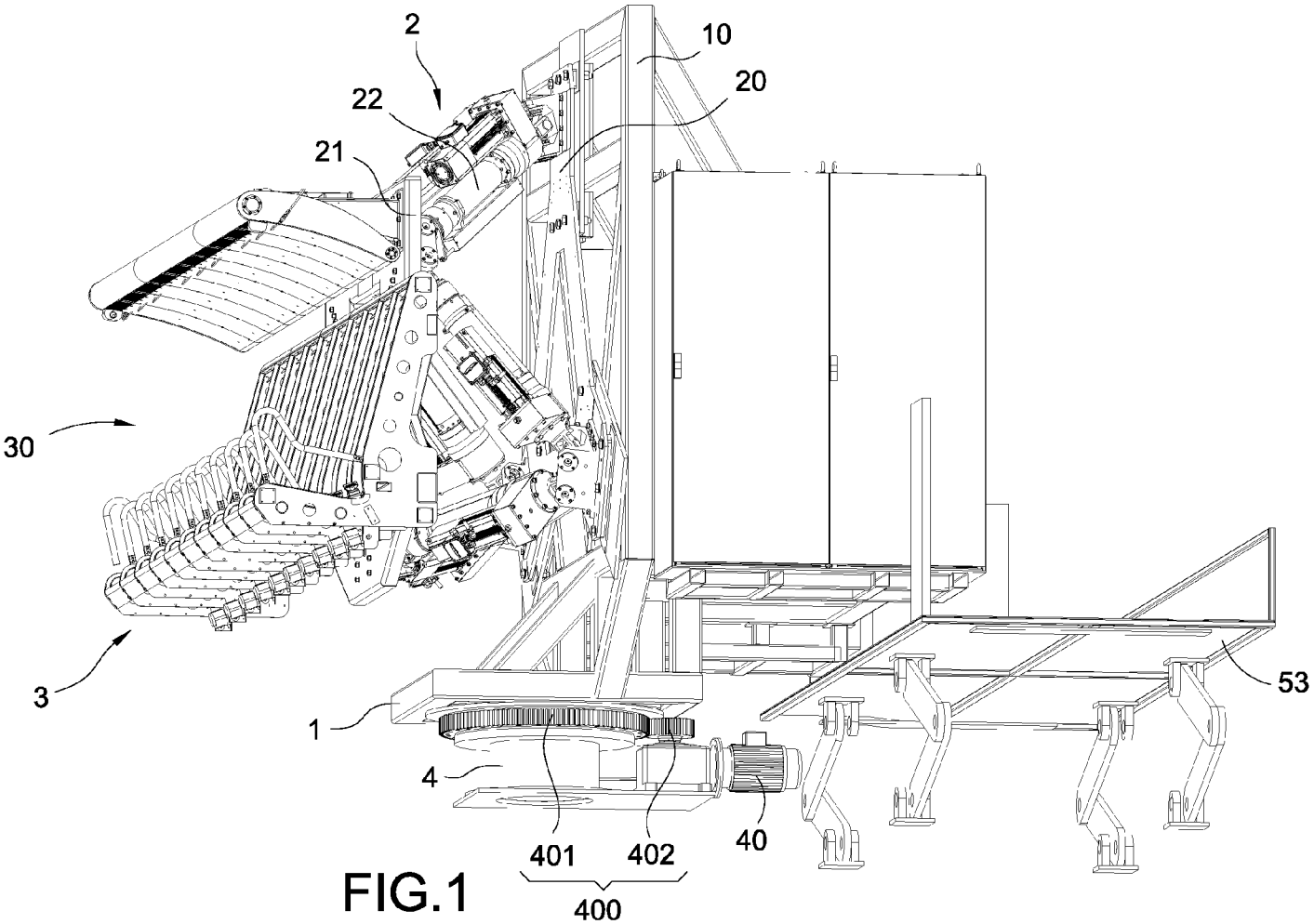
FIG. 1 is a perspective view of a rotary dynamic simulation device according to the present invention.
Figure 3:
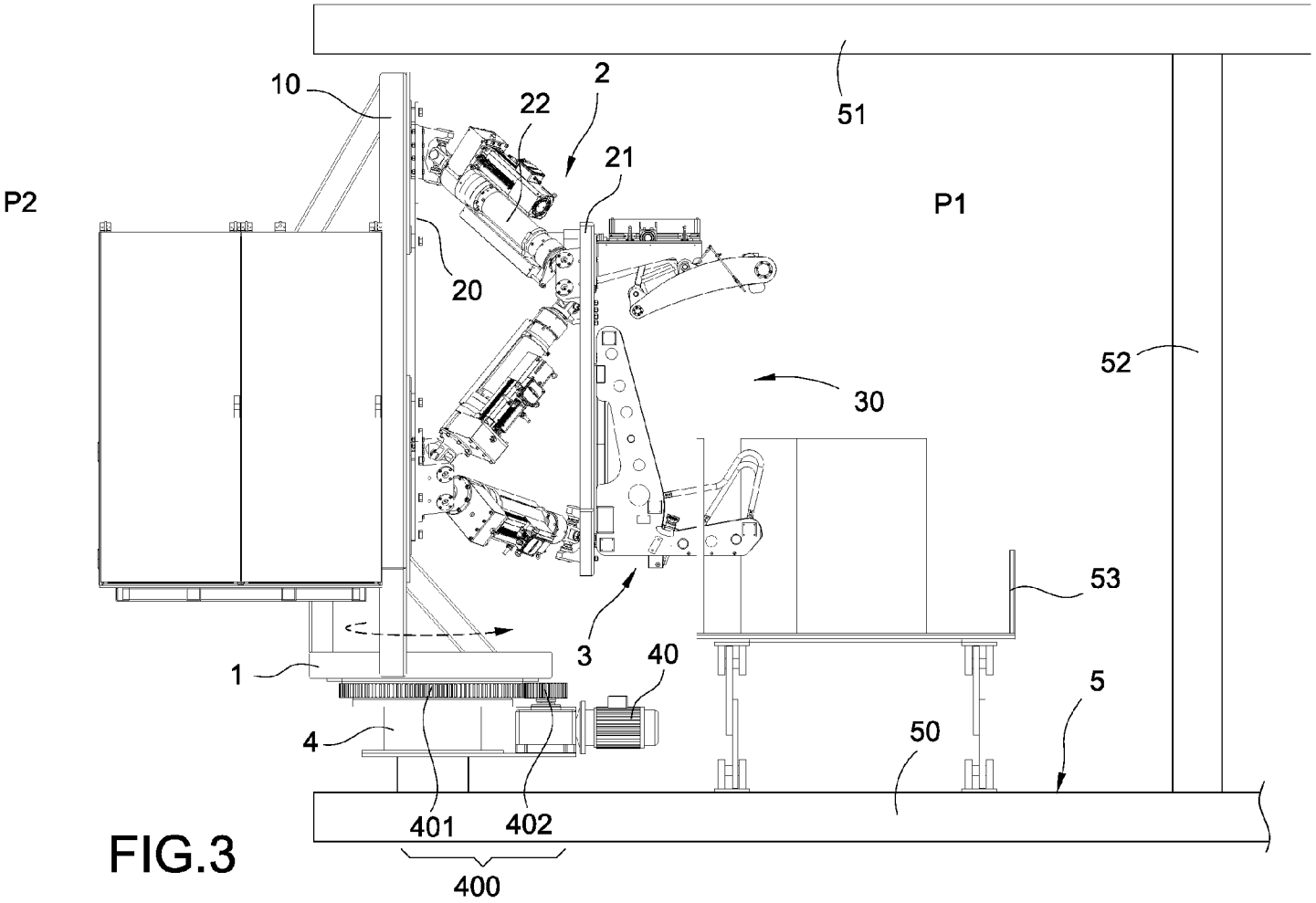
FIG. 3 is a schematic view showing that a carrying seat of the rotary dynamic simulation device is in the first position.
Figure 4:
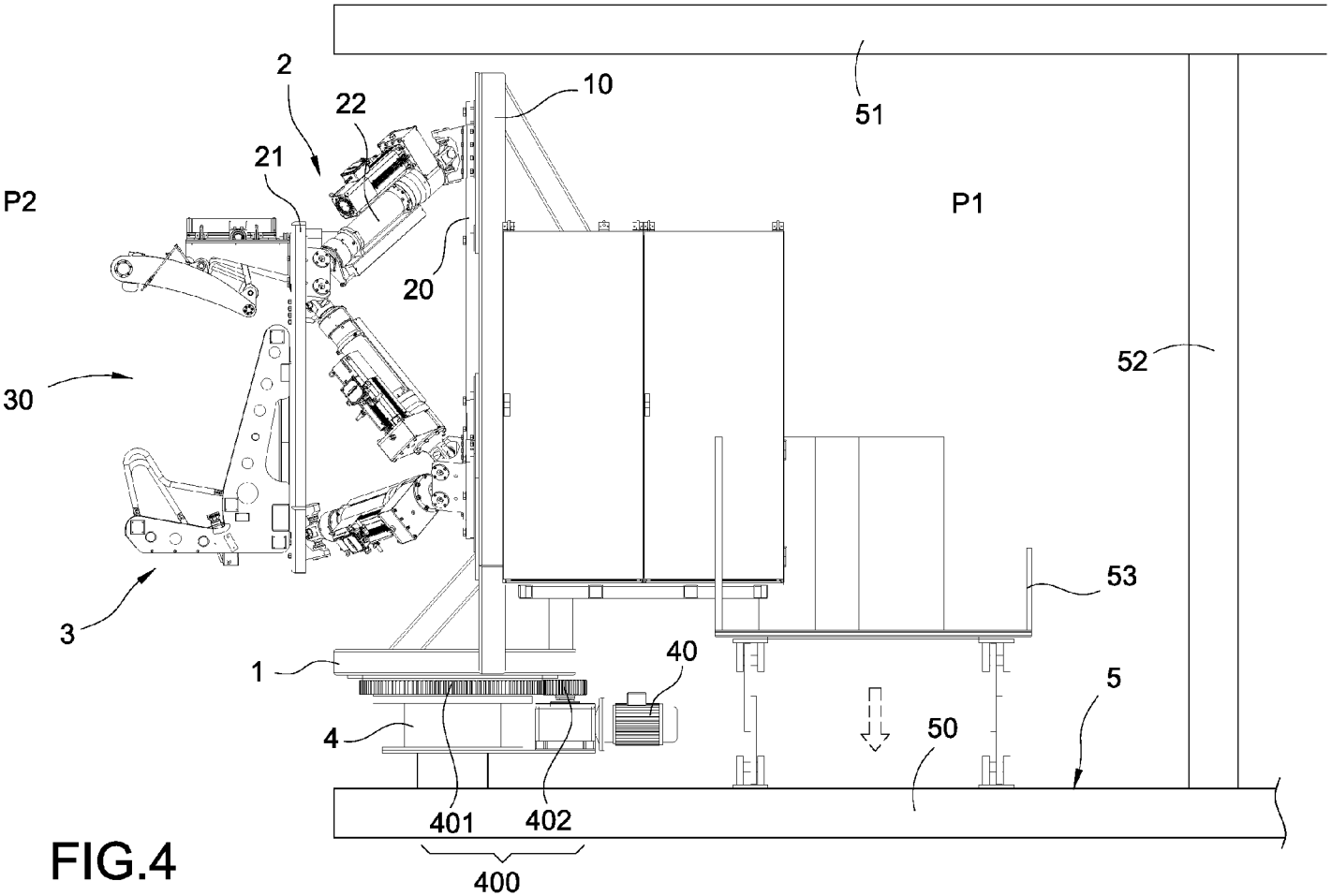
FIG. 4 is a schematic view showing that the carrying seat of the rotary dynamic simulation device is in the second position.
Figure 6:
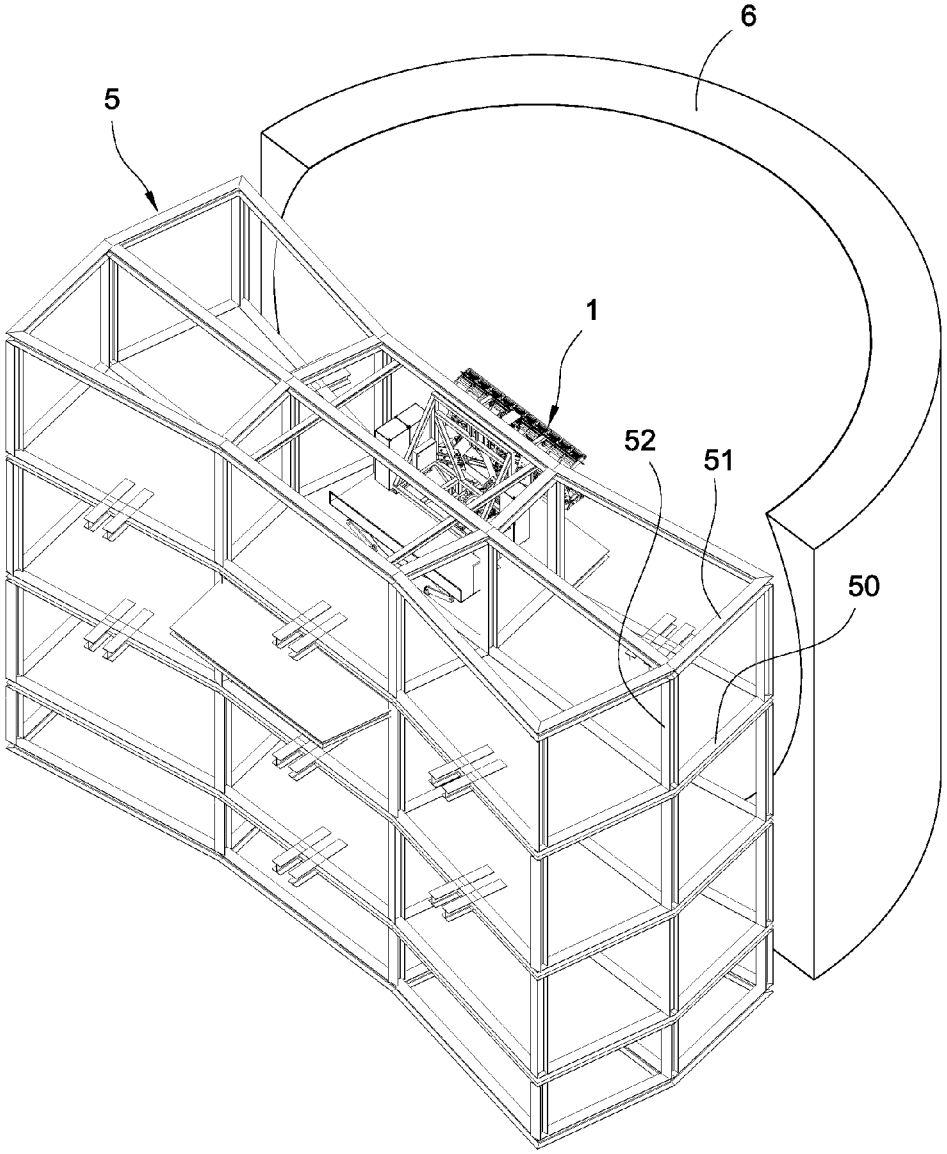
FIG. 6 is a perspective view of an audiovisual apparatus according to the present invention.
Figure 7:
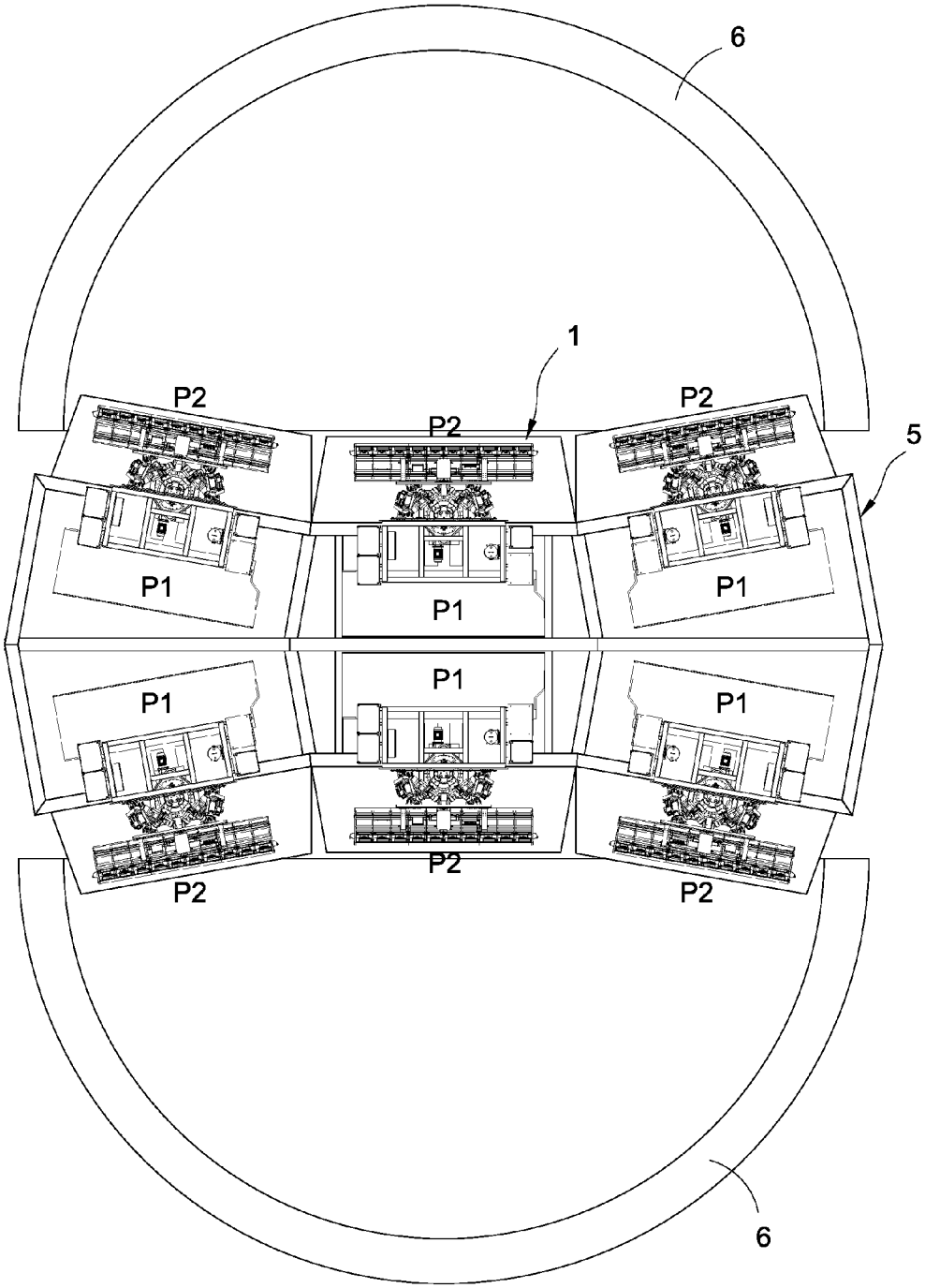
FIG. 7 is a top view of the audiovisual apparatus according another embodiment of the present invention.

Please refer to FIGS. 1, 3, and 4 which are respectively a perspective view of a rotary dynamic simulation device, a schematic view showing a carrying seat of the rotary dynamic simulation device being in the first position, a schematic view showing the carrying seat of the rotary dynamic simulation device being in the second position according to the present invention. The present invention provides a rotary dynamic simulation device, and the rotary dynamic simulation device is disposed on the rack 5 of an audiovisual apparatus (as shown in FIG. 6 or FIG. 7). The rack 5 includes a first position P1 and a second position P2 opposite to the first position P1. The first position P1 is an entering position from which a viewer gets on the rotary dynamic simulation device, and the second position P2 is a watch position to which the viewer is sent for a realistic experience. The viewer enters the dynamic simulation device from the first position P1 to seat himself, and is sent to the second position P2 by means of the rotary dynamic simulation device. The rotary dynamic simulation device includes a fixed table 1, a motion mechanism 2, a carrying seat 3, and a rotation mechanism 4.

The fixed table 1 is adapted to position and secure the rotary dynamic simulation device on the rack 5 of the audiovisual apparatus, and an arm 10 is vertically disposed thereon for installing the motion mechanism 2.

The motion mechanism 2 has 6 degrees of freedom and includes a fixed plate 20, a movable plate 21, and a plurality of telescopic rods 22 connected between the fixed plate 20 and the movable plate 21, thereby forming the motion mechanism 2 having multiple degrees of freedom like a Stewart platform. Since the motion mechanism 2 is a conventional technique and is not within the protection scope of the present invention, so detailed descriptions are omitted herein for brevity.

The carrying seat 3 is adapted for seating the viewer. The carrying seat 3 includes a carrying space 30, the movable plate 21 of the motion mechanism 2 is fixed to any position at a back side of the carrying space 30, the fixed plate 20 of the motion mechanism 2 is fixed to the arm 10 of the fixed table 1, and thereby the carrying seat 3 can be suspended by the fixed securement provided by the motion mechanism 2, at the same time the motion mechanism 2 does not block the view in front of the carrying seat 3, and the lateral configuration reduces the overall vertical space, which is beneficial to make scenic designs and surrounding layouts.

Figure 2:
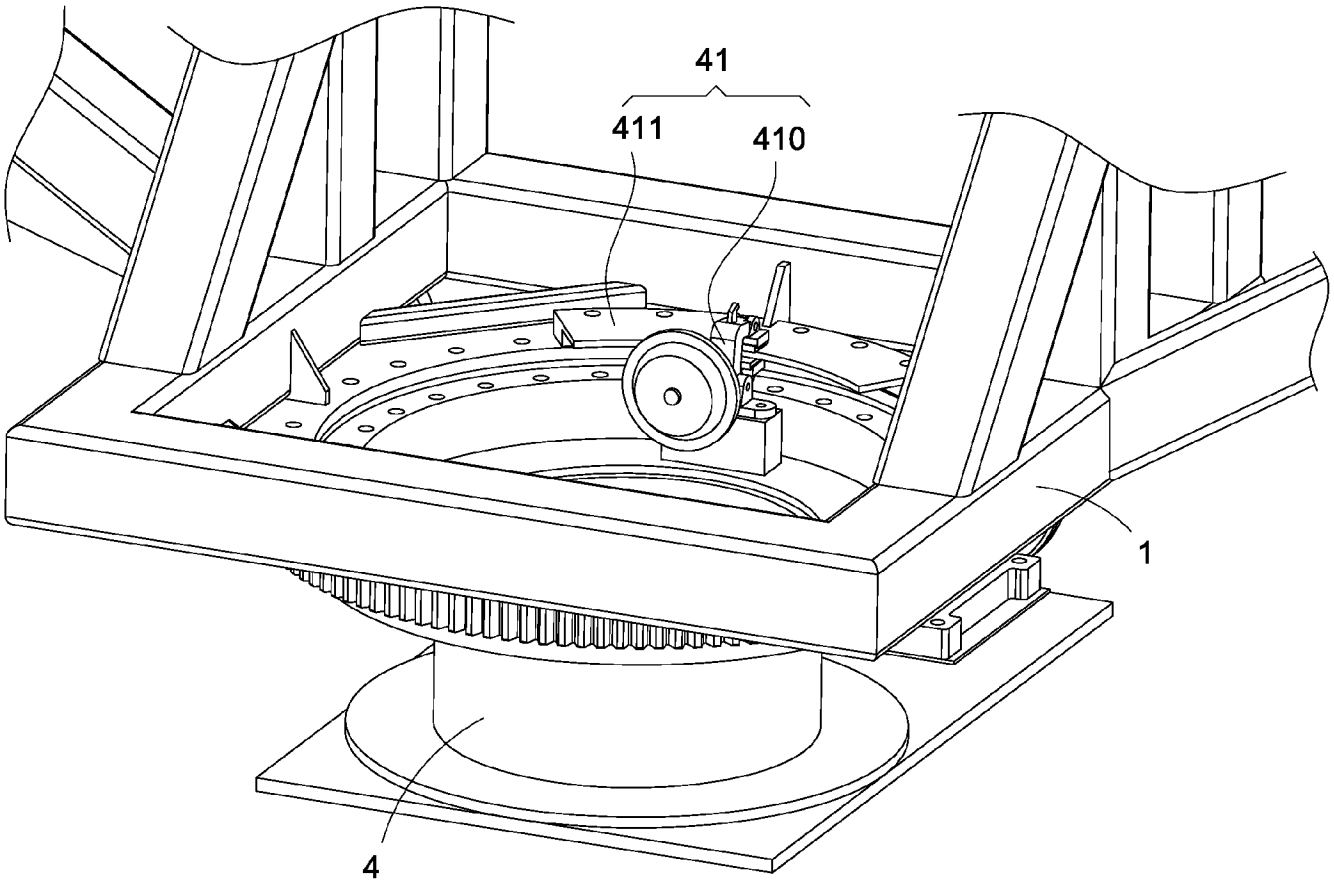
FIG. 2 is a perspective view of the rotary dynamic simulation device according to the present invention.

Referring to FIG. 2, by utilizing the rotation mechanism 4 disposed on the rack 5, the rotation mechanism 4 drives the fixed table 1 to rotate planarly, thereby driving the carrying seat 3 to rotate between the first position P1 and the second position P2 of the rack 5, as shown in FIGS. 3 and 4. To be specific, the rack 5 includes a lower board 50, an upper board 51, and an upright pole 52 to support the upper board 51 above the lower board 50, and an elevator platform 53 can be disposed on the lower board 50 corresponding to the first position P1. The second position P2 is suspended outside the lower board 50, and the rotation mechanism 4 is disposed on the lower board 50. In the present embodiment, the rotation mechanism 4 is disposed below the fixed table 1. Furthermore, the rotation mechanism 4 includes a drive unit 40. The drive unit 40 can be a control motor for controlling the rotation mechanism 4 via the transmission wheel assembly 400 to rotate by a predetermined angle or in a predetermined range. The transmission wheel assembly 400 includes a first transmission wheel 401 disposed on the rotation mechanism 4 and a second transmission wheel 402 engaged with the first transmission wheel 401 and driven by the drive unit 40. The first transmission wheel 401 can be a large gear or a large friction wheel. The second transmission wheel 402 can be a relatively smaller gear or friction wheel and can be provided with a brake device 41. The brake device 41 includes an actuating element 410 and a brake element 411 which are disposed between the rotation mechanism 4 and the fixed table 1, so as to brake when the fixed table 1 is rotated by the rotation mechanism 4 to a fixed position (the first position P1 or the second position P2), thereby ensuring safety for the viewer by preventing the rotation mechanism 4 from wobbling or continuing to rotate/move, and the rotation mechanism 4 can brake immediately to stop its rotation when an emergency occurs.

Figure 5:
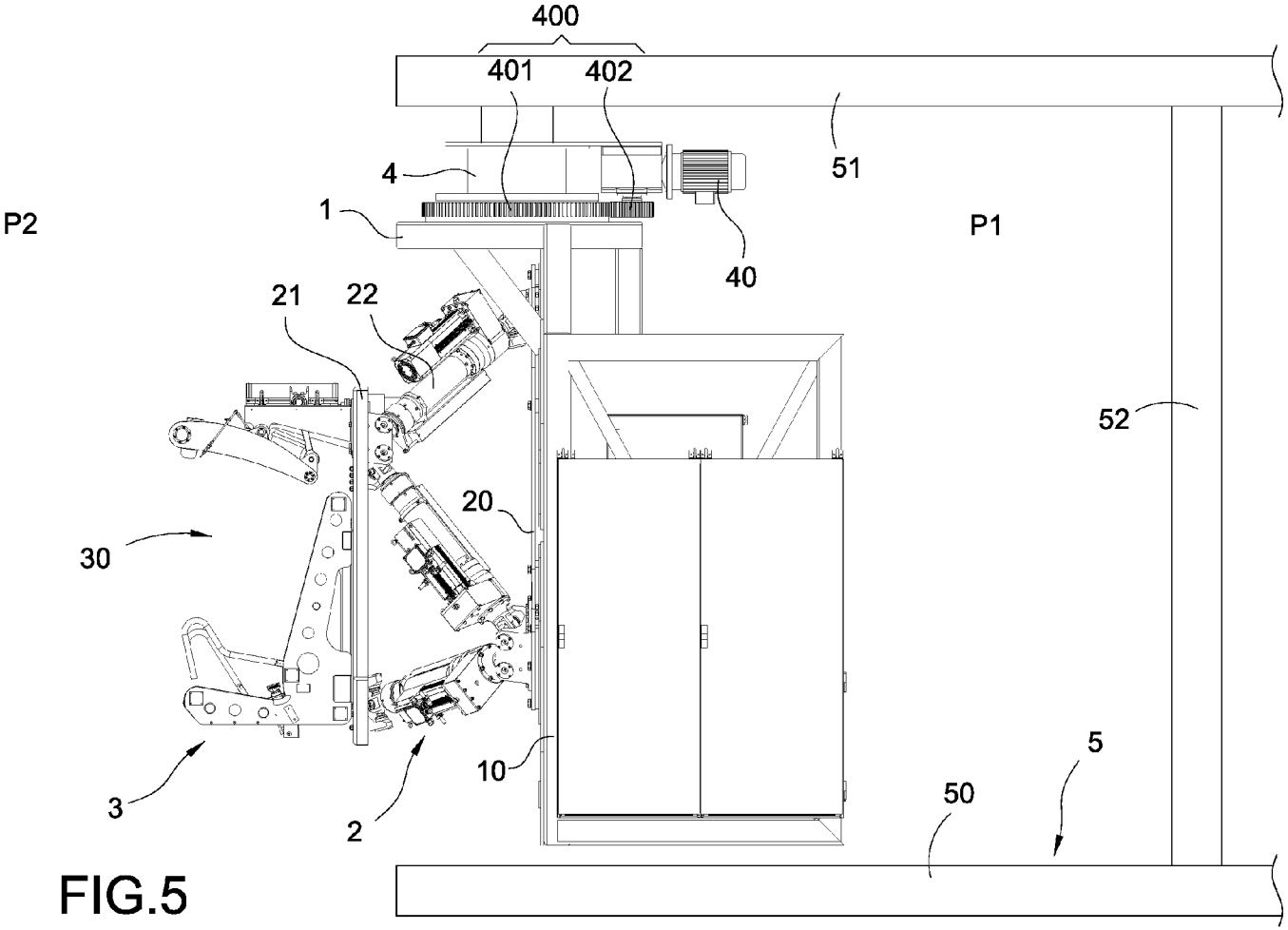
FIG. 5 is a schematic view showing the rotary dynamic simulation device in use according to another embodiment.

Furthermore, as shown in FIG. 5, the rotation mechanism 4 can be disposed under the upper board 51 of the rack 5. In the present embodiment, the rotation mechanism 4 is disposed above the fixed table 1, so that the entire rotary dynamic simulation device is suspended in the rack 5.

Furthermore, referring to FIG. 6, the present invention provides an audiovisual apparatus having the rotary dynamic simulation device. The audiovisual apparatus includes the rack 5 and a screen 6. At least one rotary dynamic simulation device is disposed on the rack 5; the rotary dynamic simulation device is mentioned above, so detailed descriptions thereof are not repeated. The rack 5 can be divided into multiple layers. A plurality of rotary dynamic simulation devices can be arranged side by side in each layer, so as to dispose more rotary dynamic simulation devices on the rack 5 for allowing more viewers to use at the same time. Therefore, the rack 5 includes a said first position P1 and a said second position P2 opposite to the said first position P1 corresponding to each of the rotary dynamic simulation devices, as shown in FIG. 7. Furthermore, there can be multiple racks disposed back to back.

The screen 6 can display pictures and/or play audio, or create a realistic effect in virtual reality, and the screen 6 is disposed corresponding to the second position P2 of the rack 5. Furthermore, as shown in FIG. 7, if there are multiple racks 5, there can be multiple screens 6, and the screens 6 correspond in number to the multiple racks 5.

The rotary dynamic simulation device of the present invention is constituted as above. In summary, the present invention can achieve functions as expected, solve problems existing in the conventional techniques, and have novelty and non-obviousness, so the present invention meets the requirements of patentability. In order to protect the right of the inventor, a request to patent the present invention is kindly solicited according to the patent law.

It is to be understood that the above descriptions are merely the preferable embodiments of the present invention and are not intended to limit the scope of the present invention. Equivalent changes and modifications made in the spirit of the present invention are regarded as falling within the scope of the present invention.

What is claimed is:

1. A rotary dynamic simulation device, disposed on a rack (5), the rack (5) having a first position (P1) and a second position (P2) opposite to the first position (P1), the rotary dynamic simulation device comprising:

a fixed table (1), an arm (10) being vertically disposed on the fixed table (1);

a motion mechanism (2) having multiple degrees of freedom and including a fixed plate (20), a movable plate (21), and a plurality of telescopic rods (22) connected between the fixed plate (20) and the movable plate (21), the fixed plate (20) being fixed on the arm (10);

a carrying seat (3) including a carrying space (30), the movable plate (21) being fixed to any position at a back side of the carrying space (30); and a rotation mechanism (4), the rotation mechanism (4) being disposed on the rack (5) and driving the fixed table (1) to thereby rotate the carrying seat (3) from the first position (P1) to the second position (P2).

2. The rotary dynamic simulation device of claim 1, wherein the rotation mechanism (4) is disposed with a brake device (41).

3. The rotary dynamic simulation device of claim 2, wherein the brake device (41) includes an actuating element (410) and a brake element (411) which are disposed between the rotation mechanism (4) and the fixed table (1).

4. The rotary dynamic simulation device of claim 3, wherein the rotation mechanism (4) includes a drive unit (40) for controlling rotation of the rotation mechanism (4).

5. The rotary dynamic simulation device of claim 4, wherein the drive unit (40) controls the rotation mechanism (4) to rotate via a transmission wheel assembly (400).

6. The rotary dynamic simulation device of claim 5, wherein the transmission wheel assembly (400) includes a first transmission wheel (401) disposed on the rotation mechanism (4) and a second transmission wheel (402) engaged with the first transmission wheel (401) and driven by the drive unit (40).

7. An audiovisual apparatus having a rotary dynamic simulation device, comprising:

a rack (5), at least one rotary dynamic simulation device of claim 1 being disposed on the rack (5), the rack (5) including a first position (P1) and a second position (P2) opposite to the first position (P1) corresponding to each of the rotary dynamic simulation devices; and a screen (6) disposed corresponding to the second position (P2).

8. The audiovisual apparatus having the rotary dynamic simulation device of claim 7, wherein the first position (P1) is an entering position, the second position (P2) is a watch position.

9. The audiovisual apparatus having the rotary dynamic simulation device of claim 8, wherein the rack (5) includes a lower board (50) and an elevator platform (53) disposed corresponding to the entering position.

10. The audiovisual apparatus having the rotary dynamic simulation device of claim 9, wherein the rotation mechanism (4) is disposed on the lower board (50) and below the fixed table (1).

11. The audiovisual apparatus having rotary type dynamic simulation device of claim 9, wherein the rack (5) further includes an upper board (51), and the rotation mechanism (4) is disposed below the upper board (51) and above the fixed table (1).

* * * * *